US009373471B2

(12) United States Patent
Goldman et al.

(10) Patent No.: US 9,373,471 B2
(45) Date of Patent: Jun. 21, 2016

(54) ELECTROMAGNETIC SWITCH WITH DAMPING INTERFACE

(71) Applicant: Tesla Motors, Inc., Palo Alto, CA (US)

(72) Inventors: Mark Goldman, Mountain View, CA (US); Ian C. Dimen, San Francisco, CA (US); Bennett Sprague, Oakland, CA (US)

(73) Assignee: TESLA MOTORS, INC., Palo Alto, CA (US)

( * ) Notice: Subject to any disclaimer, the term of this patent is extended or adjusted under 35 U.S.C. 154(b) by 193 days.

(21) Appl. No.: 14/094,662

(22) Filed: Dec. 2, 2013

(65) Prior Publication Data

US 2015/0155112 A1 Jun. 4, 2015

(51) Int. Cl.

| | |
|---|---|
| ***H01H 50/30*** | (2006.01) |
| *H01H 50/20* | (2006.01) |
| *H01H 50/54* | (2006.01) |

(52) U.S. Cl.

CPC ..... *H01H 50/305* (2013.01); *H01H 50/20* (2013.01); *H01H 50/546* (2013.01); *Y10T 29/49105* (2015.01)

(58) Field of Classification Search

CPC ..... H01H 11/00; H01H 3/60; H01H 35/142
See application file for complete search history.

(56) References Cited

U.S. PATENT DOCUMENTS

| | | | | |
|---|---|---|---|---|
| 2,783,340 | A * | 2/1957 | Davies | H01H 9/04 174/153 R |
| 3,189,705 | A * | 6/1965 | Geusendam | 335/194 |
| 3,513,420 | A * | 5/1970 | Griffith et al. | 335/164 |
| 4,497,991 | A * | 2/1985 | Sturzenegger et al. | 218/57 |
| 8,836,455 | B2 * | 9/2014 | Gu et al. | 335/105 |
| 2006/0261916 | A1 | 11/2006 | Molyneux et al. | |
| 2007/0194867 | A1 | 8/2007 | Kurasawa | |
| 2009/0094789 | A1 * | 4/2009 | Bereznai | 16/84 |
| 2011/0193662 | A1 | 8/2011 | Swartzentruber et al. | |
| 2012/0092097 | A1 | 4/2012 | Choi | |
| 2012/0212307 | A1 * | 8/2012 | Kimura et al. | 335/189 |
| 2013/0256960 | A1 | 10/2013 | Marienfeld | |

FOREIGN PATENT DOCUMENTS

| | | | |
|---|---|---|---|
| EP | 2348521 | A2 | 7/2011 |
| EP | 2442343 | A2 | 4/2012 |
| JP | 2005-026182 | A | 1/2005 |
| KR | 10-2009-57272 | A | 6/2009 |
| KR | 10-2012-39272 | A | 4/2012 |

OTHER PUBLICATIONS

International search report in application PCT/US2014/067070, dated Mar. 12, 2015, 9 pages.

* cited by examiner

*Primary Examiner* — Mohamad Musleh
(74) *Attorney, Agent, or Firm* — Haynes and Boone, LLP

(57) ABSTRACT

An electromagnetic switch includes: a stationary electrical contact; a moveable electrical contact; an actuated member to which the moveable electrical contact is attached for driving the moveable electrical contact into and out of contact with the stationary electrical contact; and a damping interface between the moveable electrical contact and the actuated member.

20 Claims, 11 Drawing Sheets

ELECTROMAGNETIC SWITCH WITH DAMPING INTERFACE

BACKGROUND

A variety of applications, such as electric vehicles, require the use of contactors and relays to control the opening and closing of various electric power lines. Under certain conditions, electric vehicles and/or other electric equipment can generate audible noise.

SUMMARY

In a first aspect, an electromagnetic switch includes: a stationary electrical contact; a moveable electrical contact; an actuated member to which the moveable electrical contact is attached for driving the moveable electrical contact into and out of contact with the stationary electrical contact; and a damping interface between the moveable electrical contact and the actuated member.

Implementations can include any or all of the following features. The damping interface is cylindrical. The damping interface is toroidal. The damping interface comprises an O-ring seated in a circumferential groove inside an opening of the moveable electrical contact through which the actuated member passes. The damping interface has a K-shape profile facing the actuated member. The damping interface has a chevron-shape profile facing the actuated member. The damping interface comprises a flexure diaphragm. The flexure diaphragm comprises a rubber washer, wherein an outer periphery of the rubber washer is attached to the moveable electrical contact inside an opening of the moveable electrical contact through which the actuated member passes, and wherein an inner periphery of the rubber washer is attached to the actuated member. The electromagnetic switch further includes a friction damper attached to the moveable electrical contact, the friction damper positioned between the moveable electrical contact and a sidewall of the electromagnetic switch. The friction damper is positioned by a metal member on which the moveable electrical contact sits. The friction damper comprises a first member biasing against the moveable electrical contact, and a second member biasing against the sidewall. The first and second members are essentially parallel and oriented in a direction that the moveable electrical contact is being driven. The first member is attached to the moveable electrical contact, and wherein the second member extends from the first member toward the sidewall. The first and second members are essentially antiparallel and orthogonal to a direction that the moveable electrical contact is being driven. One end of the friction damper is attached to the moveable electrical contact and another end biases against the sidewall.

In a second aspect, a method includes: providing a stationary electrical contact for an electromagnetic switch; attaching a moveable electrical contact to an actuated member for driving the moveable electrical contact into and out of contact with the stationary electrical contact; and providing a damping interface between the moveable electrical contact and the actuated member.

Implementations can include any or all of the following features. The method further includes providing a circumferential groove inside an opening of the moveable electrical contact through which the actuated member passes, wherein the damping interface comprises an O-ring seated in the circumferential groove. The damping interface comprises a rubber washer, and the method further includes attaching an outer periphery of the rubber washer to the moveable electrical contact inside an opening of the moveable electrical contact through which the actuated member passes, and attaching an inner periphery of the rubber washer to the actuated member. The method further includes attaching a friction damper to the moveable electrical contact, the friction damper positioned between the moveable electrical contact and a sidewall of the electromagnetic switch.

DETAILED DESCRIPTION

This document describes examples of damping an electromagnetic switch to reduce or eliminate unwanted oscillatory effects. These oscillatory effects are facilitated by mechanical resonances. In the switch, a moveable contact has some degree(s) of freedom to move relative to the shaft to which it is attached and relative to the stationary electrical contacts against which it is pressed when in the closed position. This shaft-contact joint can be dampened in one or more ways to address the problem of noise generated by the switch during operation. By increasing the damping above a threshold, one can eliminate the unwanted oscillatory effect generated by the moveable contact. Such a threshold is the point where the energy absorbed by the damper during each cycle of oscillation is greater than the energy added by the force generated by flowing DC current acting in conjunction with the motion of the moveable contact. While DC is mentioned as an example, it is believed that oscillation can occur with any current (i.e., also AC) that is sufficiently large. That is, the flow of current in conjunction with the motion of the contact is adding energy to the unwanted motion whether or not the current has a vibratory component.

Figure 1:
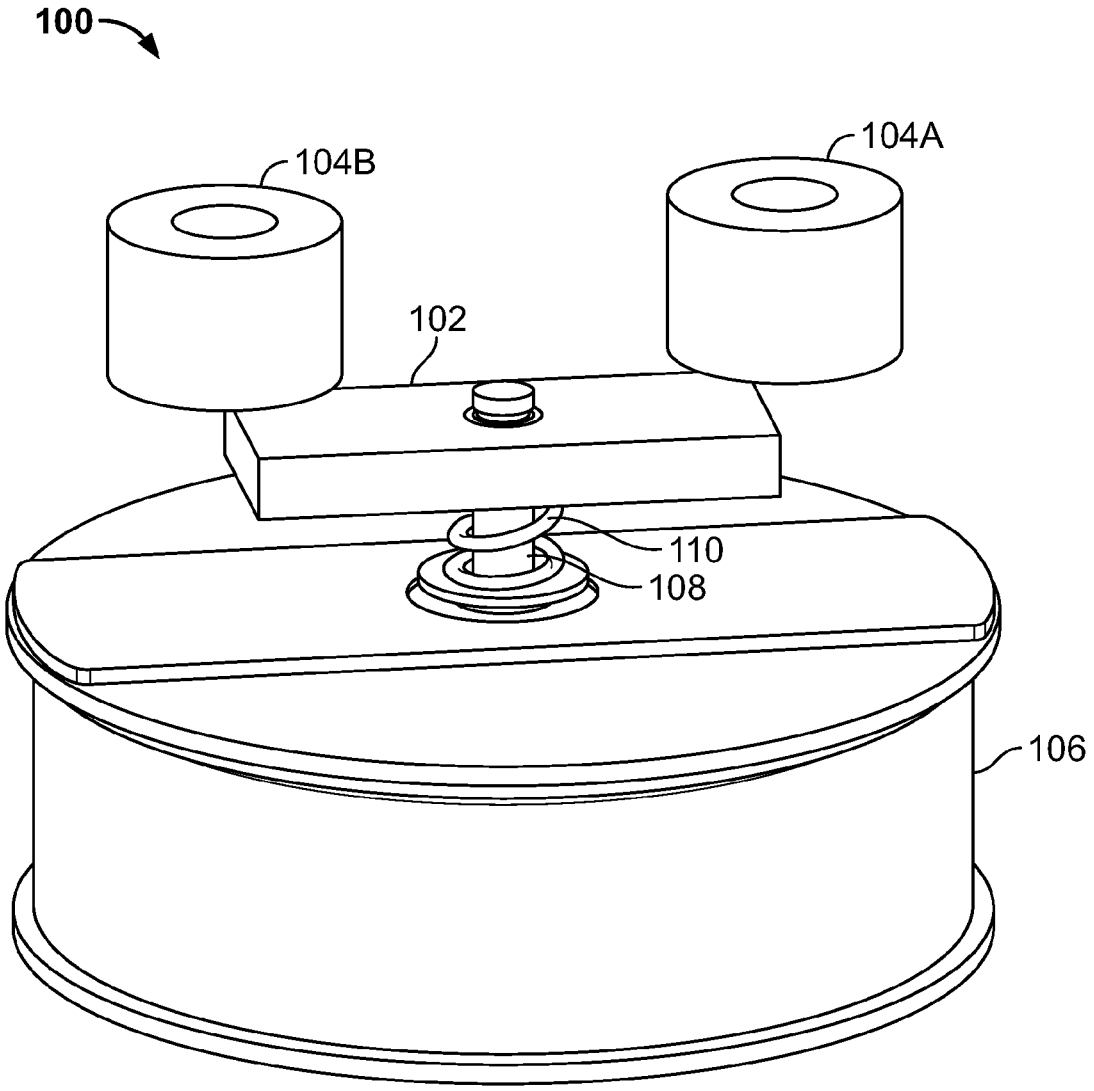
FIG. 1 shows an elevated view of an electromagnetic switch.

FIG. 1 shows an elevated view of an electromagnetic switch 100. In some implementations, the switch is part of the power electronics of an electric drivetrain. For example, an electric vehicle can have electromagnetic switches used to control the electrical connections between vehicle subsystems. In the current example, only one electromagnetic switch is illustrated, and some components thereof are not shown for clarity. Nevertheless, with regard to characteristics or aspects not explicitly mentioned here, the electromagnetic switch can operate similarly or identically to conventional switches.

The electromagnetic switch 100 has a moveable contact 102 that is configured to be moved into and out of contact with stationary contacts 104A-B. For example, the stationary contacts can be considered positive (+) and negative (−) terminals, respectively, of an electric circuit. In a closed position, the moveable contact forms an electric path between the stationary contacts. For example, this can allow a current to flow from one of the stationary contacts to the other.

The electromagnetic switch 100 has a solenoid 106 that actuates a shaft 108, or any other type of actuated member. Particularly, the solenoid interacts with an armature that is connected to the shaft 108 inside the solenoid, and thereby drives the shaft. The moveable contact 102 is attached to the shaft. For example, an opening for the shaft is formed in the moveable contact. The opening can be a hole that extends through the entire thickness of the moveable contact, as in the current example.

The reciprocal motion of the shaft and the moveable contact can be facilitated by one or more springs. In some implementations, the moveable contact is spring loaded. For example, a helical spring 110 is here placed around the shaft 108 on the outside of the solenoid, between the moveable contact 102 and the top of the solenoid.

A damping interface is provided between the shaft and the moveable contact. Examples of damping interfaces are described below.

Figure 2:
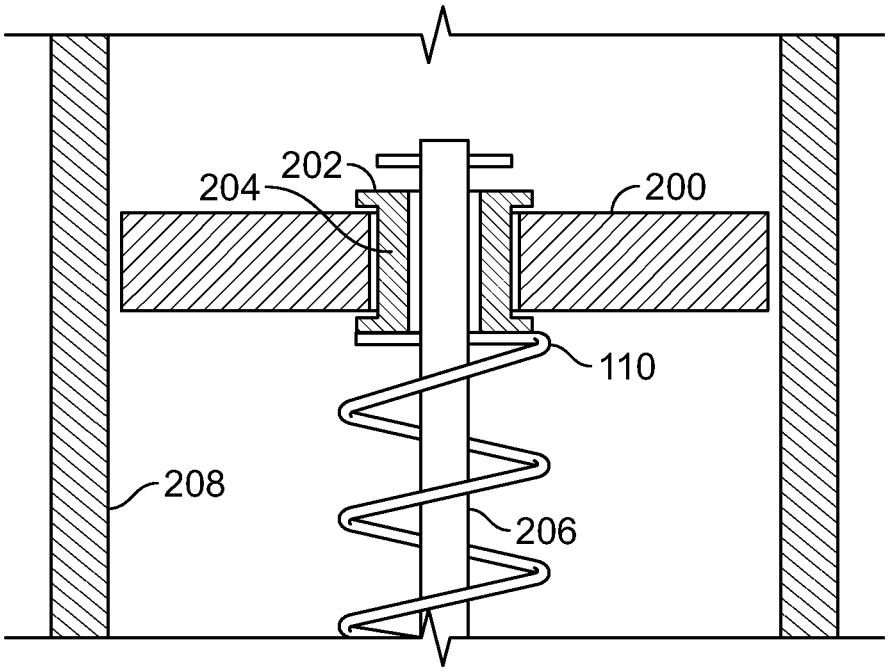
FIG. 2 shows an example of a moveable contact having an annular damper in an opening for a shaft.

FIG. 2 shows an example of a moveable contact 200 having an annular damper 202 in an opening 204 for a shaft 206. This illustration shows the components in cross section during operation, wherein the helical spring 110 supports the moveable contact.

The annular damper 202 is here essentially cylinder shaped with a lip extending radially outward. For example, the lip can reduce the occurrences of the annular damper moving along the shaft as a result of the reciprocal motion of the moveable contact. For example, the annular damper could otherwise have a tendency to walk down the shaft as the contact is repeatedly being driven into and out of contact with the stationary electric contacts, which contacts are not shown here for simplicity. With or without the lip(s), the annular damper can be dimensioned to be friction fit inside the opening 204.

The annular damper can be manufactured from any material that is suitable based on the intended use of the annular damper to dampen resonance that leads to oscillation of an electromagnetic switch. For example, the annular damper can be made of rubber having a durometer low enough to provide substantial damping, yet high enough that the annular damper is not so deformed by the forces involved that it is dislocated during normal operation.

The moveable contact is located between sidewalls 208. The sidewalls can be made of any suitable insulating material, including, but not limited to, plastic or a ceramic material.

In operation, the shaft 206, actuated by a solenoid or other device, will drive the moveable contact in reciprocal motion relative to stationary contacts. In such motion, a certain amount of play can occur between the contact and the shaft. For example, in various phases of the stroke the contact can slide about along the shaft. The contact can also or instead have some rotational freedom about the shaft. For example, when the damping interface is rotationally symmetric with regard to the shaft, the damping interface can provide useful reduction or elimination of oscillation in several or all of the different positions that the moveable contact assumes relative to the shaft.

Figure 3:
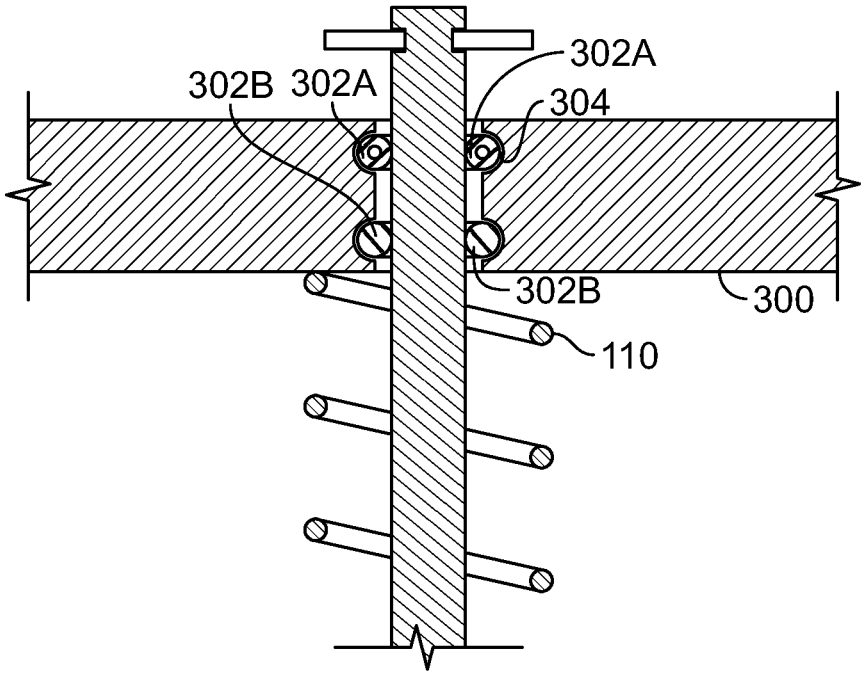
FIG. 3 shows an example of a moveable contact having O-rings in the opening for the shaft.

FIG. 3 shows an example of a moveable contact 300 having O-rings in an opening for the shaft 206. The O-rings are seated in respective grooves 304 in the inside of the opening. In assembly, the O-rings can be put in place first, and thereafter the shaft can be inserted through the opening and the O-rings.

The O-rings will serve to dampen oscillation in the moveable contact and the shaft during operation. The O-ring can be made from any suitable material, including, but not limited to, rubber. The O-ring 302A is here hollow whereas the O-ring 302B is solid. In other implementations, more than one O-ring can be hollow, and/or more than one O-ring can be solid. As another example, the contact can have only a single O-ring, or can have more than two O-rings.

Figure 4:
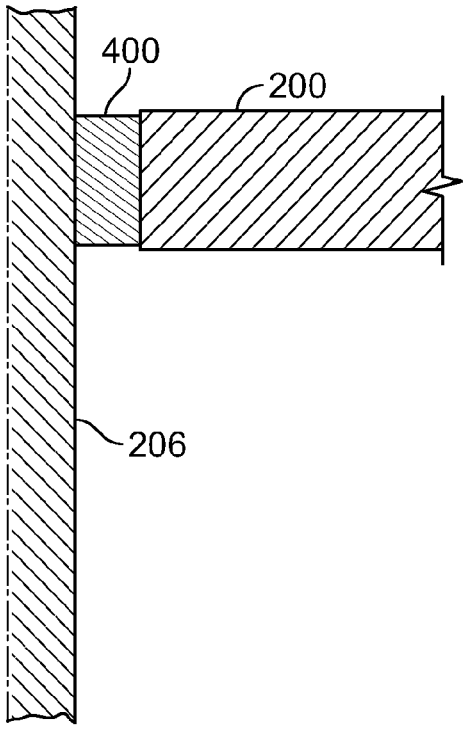
FIG. 4 shows an example of a cylindrical member mounted in the opening for the shaft.

FIG. 4 shows an example of a cylindrical member 400 mounted in the opening for the shaft 206. That is, the moveable contact 200 here is provided with the cylindrical member as a way of reducing or eliminating unwanted oscillation. In this and some later examples, half of the rotationally symmetric seal (e.g., the member 400) is being shown for simplicity.

The cylindrical member can have a friction fit inside the contact opening to stay in place. In some implementations, the member 400 can be seated in a recess of the contact, in analogy with the groove 304 (FIG. 3). In some implementations, the cylindrical member can be co-molded onto the inward facing surface of the opening. For example, the attachment surface can be knurled, ribbed, or otherwise shaped to provide a better attachment for the material of the damping member. In some implementations, the rotary damping member (e.g., the member 400 in this example) can instead, or additionally, be attached in another way, such as by an adhesive.

Figure 5:
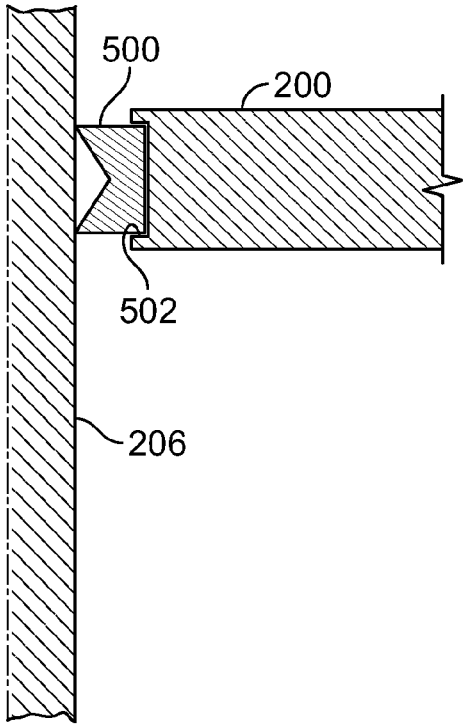
FIG. 5 shows an example of a chevron-shaped member mounted in the opening for the shaft.

FIG. 5 shows an example of a chevron-shaped member 500 mounted in the opening for the shaft 206. The member 500 is seated in a recess 502 formed in the moveable contact.

Figure 6:
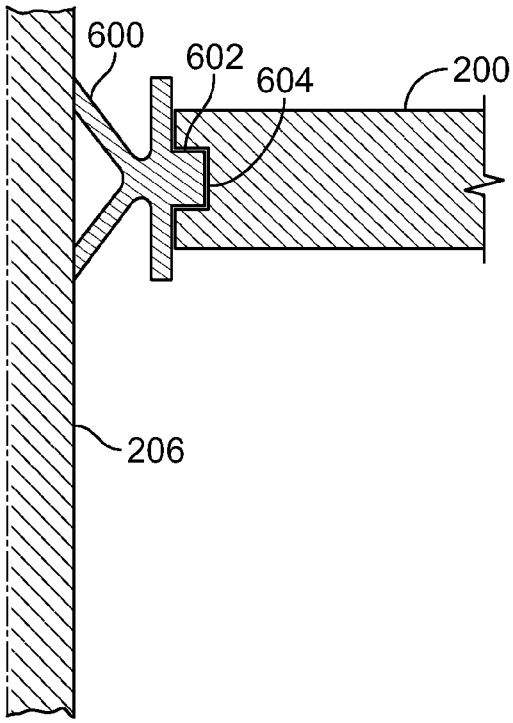
FIG. 6 shows an example of a K-shaped member mounted in the opening for the shaft.

FIG. 6 shows an example of a K-shaped member 600 mounted in the opening for the shaft 206. The member 600 here has a lip 602 extending around all or some of its circumference. The lip fits into a recess 604 in the moveable contact.

Figure 7:
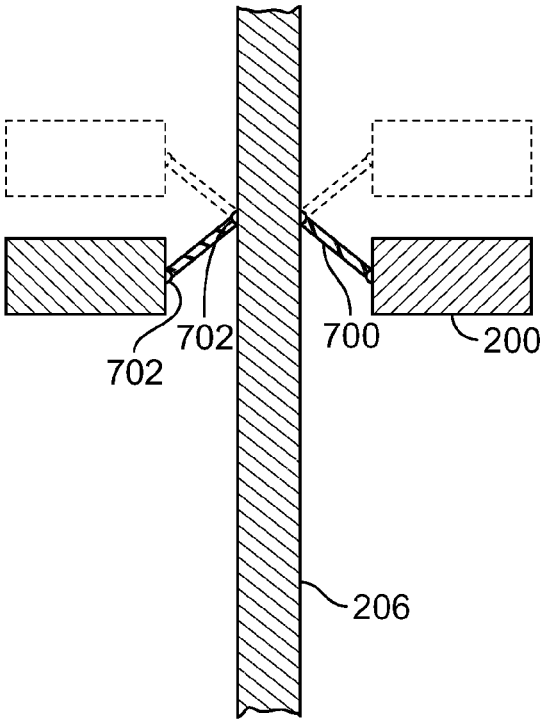
FIG. 7 shows an example of a flexure washer mounted in the opening for the shaft.

FIG. 7 shows an example of a flexure washer 700 mounted in the opening for the shaft 206. The flexure washer can be made from any suitable material that will substantially dampen oscillation, including, but not limited to rubber. For example, at its outer edge the flexure washer can be attached to the moveable contact 200, and at its inner edge it can be attached to the shaft, such as by adhesive 702. In some implementations, one or both edges of the washer can be friction fit against the contact or the shaft, respectively.

In operation, the flexure washer can be flexed as a result of play between the moveable contact and the shaft. Here, the moveable contact is shown in a lower position, and a corresponding upper position is indicated in phantom. In other implementation, the amount of flexing can be different that in this example.

Some implementations can substantially reduce the amount of oscillation generated in an electromagnetic switch. For example, the present inventors have proposed the explanation that unwanted noise in an electromagnetic relay under high current is caused by current-driven vibrations in the moveable contact during operation. Some testing has therefore been performed. The electromagnetic switch used in this testing was one that was known to exhibit significant audible noise generation in test situations. The following are results of the testing.

Figure 8:
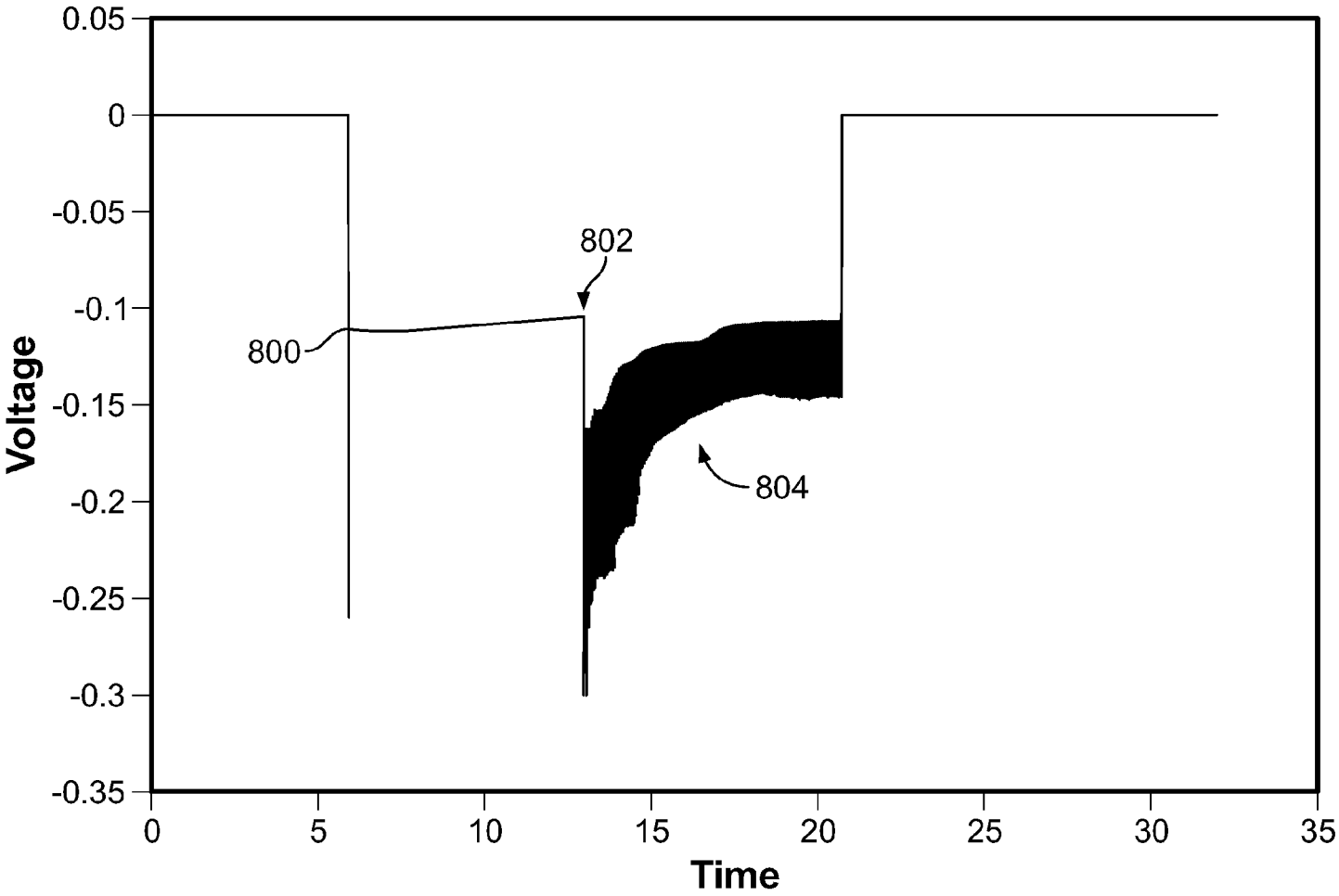
FIG. 8 illustrates an example of oscillation in an electromagnetic switch initiated by an external impact.

FIG. 8 illustrates an example of oscillation in an electromagnetic switch initiated by a mechanical impulse on the exterior case of the electromagnetic switch. The graph shows voltage on the vertical axis as a function of time. The voltage in this testing was measured across the stationary contacts of the switch. Variation in the measured voltage is indicative of whether there are vibrations in the moveable contact. That is, when the contact is vibrating, the resistance through the contact changes, compared to when no vibrations are occurring. By measuring the voltage, one learns the change in the resistance, if any, and can consequently determine whether the contact is vibrating.

The testing presented in this graph was performed on the unmodified relay; that is, without the damping interface. The relay is powered and closed during the duration of the test. Initially, the power supply for the circuit that included the high power terminals of the relay was off, and the graph indicates zero voltage starting at zero seconds. At approximately six seconds, the power supply was turned on, and the switch began conducting current. The voltage initially dropped from zero to about negative 0.25V, after which it settled to a relatively constant level at a first point 800. That is, the relatively steady voltage starting at this moment indicates that no substantial vibration is occurring.

At approximately 13 seconds into the graph, however, the electromagnetic switch was deliberately perturbed by rapping the exterior case of the relay with a metal tool at a point 802. This caused the relay to vibrate audibly, and measured voltage to rapidly oscillate, first down to about negative 0.3V, and thereafter to somewhat higher negative values, which is reflected by a pattern 804 in the chart. The pattern indicates that the resistance in the moveable contact is quickly fluctuating within essentially a band of oscillating values, which reflects oscillation in the electromagnetic switch. At approximately 21 seconds into the graph, the power supply was turned off, and the oscillation therefore ended.

Figure 9:
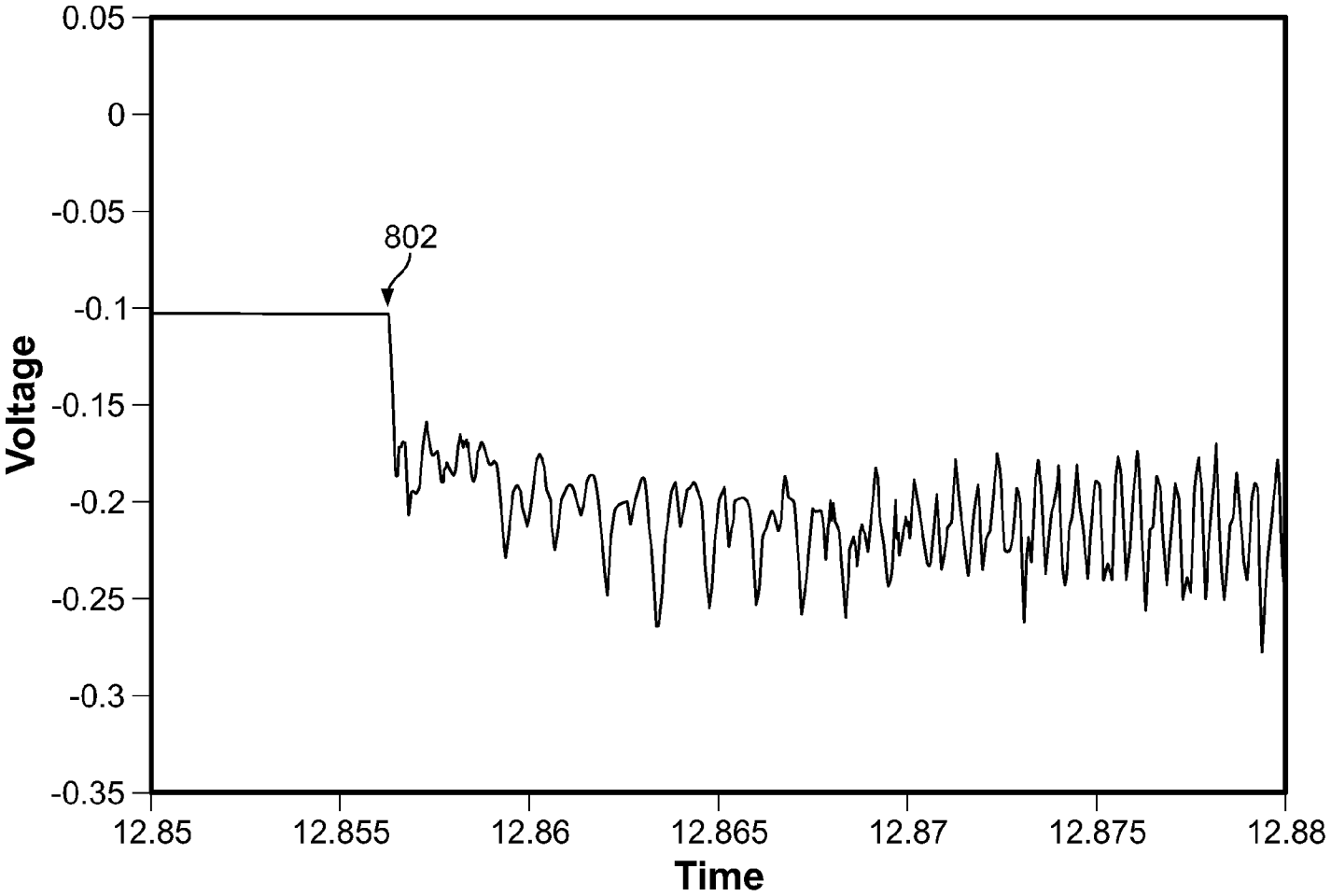
FIG. 9 shows an enlarged portion of the graph in FIG. 8.

FIG. 9 shows an enlarged portion of the graph in FIG. 8. The point 802 where the exterior case was rapped is marked, and the graph shows the resulting oscillation of the voltage over a period of time. That is, these voltage fluctuations reflect the ongoing oscillation in the moveable contact.

In this instance the testing indicated that the resonance in question was an angular motion about a line passing through the two contact points between the moveable bar and each of the stationary contacts. As such, the restoring force that causes this motion to exhibit resonant behavior would be the result of compression of the spring resulting from an angular displacement of the bar for the rest position and the profile of the contacting electrode faces.

A damping member was then created that is in principle analogous to one of, or a combination of, the implementations described above. After the damping member was added and the relay was again assembled, testing was repeated to evaluate the impact of the damping.

Figure 10:
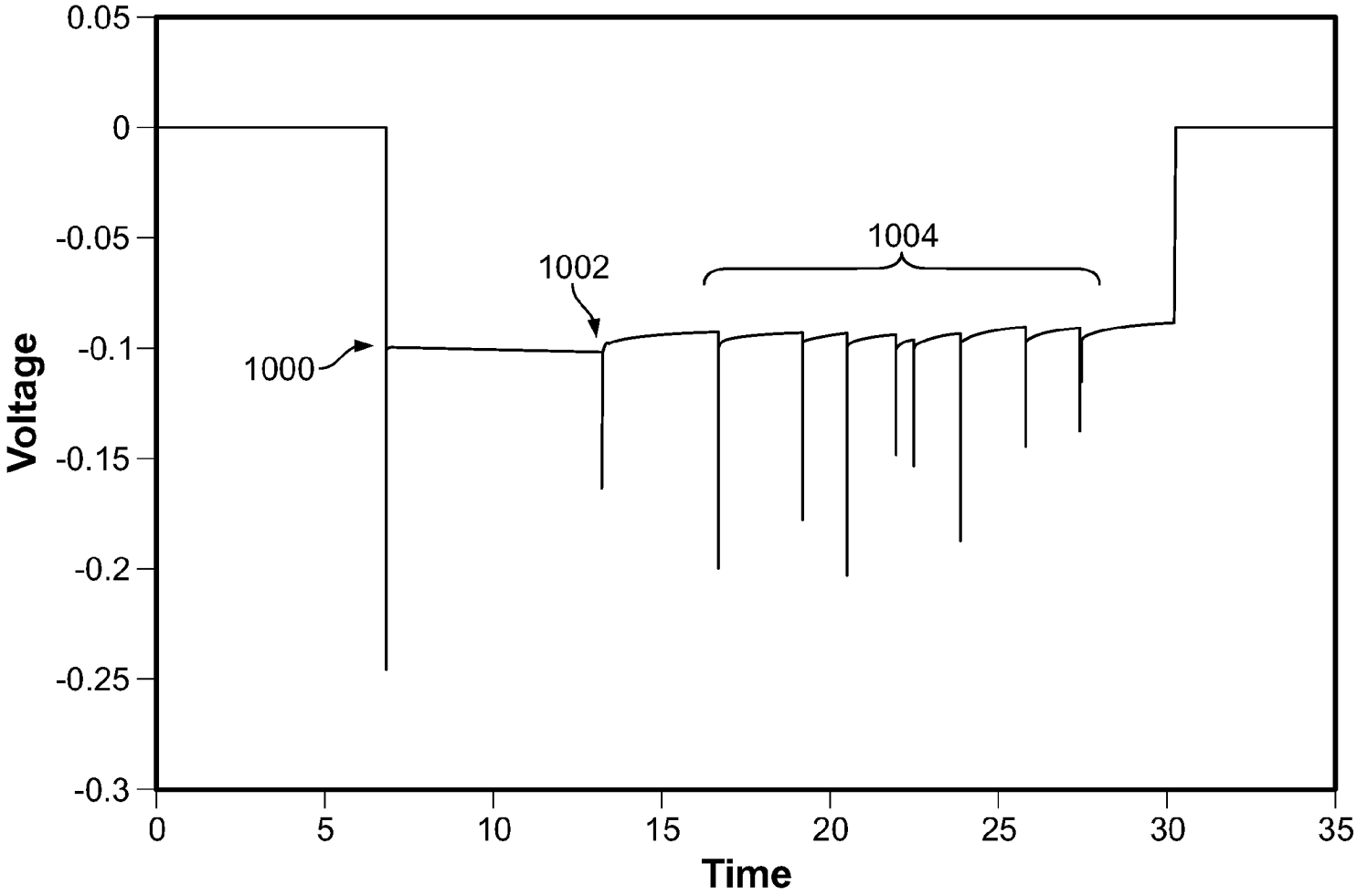
FIG. 10 illustrates an example of external impact on an electromagnetic switch having a damping interface between a shaft and a moveable contact.

FIG. 10 illustrates an example of external impact on an electromagnetic switch having the damping interface between the shaft and the moveable contact. Here, power was turned on at approximately seven seconds into the graph, and after the initial voltage dip, the voltage stabilized at a point 1000.

At a point 1002, about 13 seconds into the graph, the housing was rapped with the metal tool. The impact caused a momentary voltage drop, much as it did at the point 802 in FIG. 8, but here the voltage quickly stabilized to a relatively steady level. That is, the present graph does not show the significant voltage fluctuations that the un-dampened contact did in the pattern 804 (FIG. 8).

Several additional impacts 1004 were made on the housing using the metal tool, and each time the resulting voltage behavior was essentially consistent with that of the initial impact at the point 1002. That is, despite repeated perturbations of the system, the electromagnetic switch did not enter the state of significant oscillation as was shown in the previous figures, and no audible vibration was detected. This testing indicated that the resonance which facilitated the oscillation was dampened.

Figure 11:
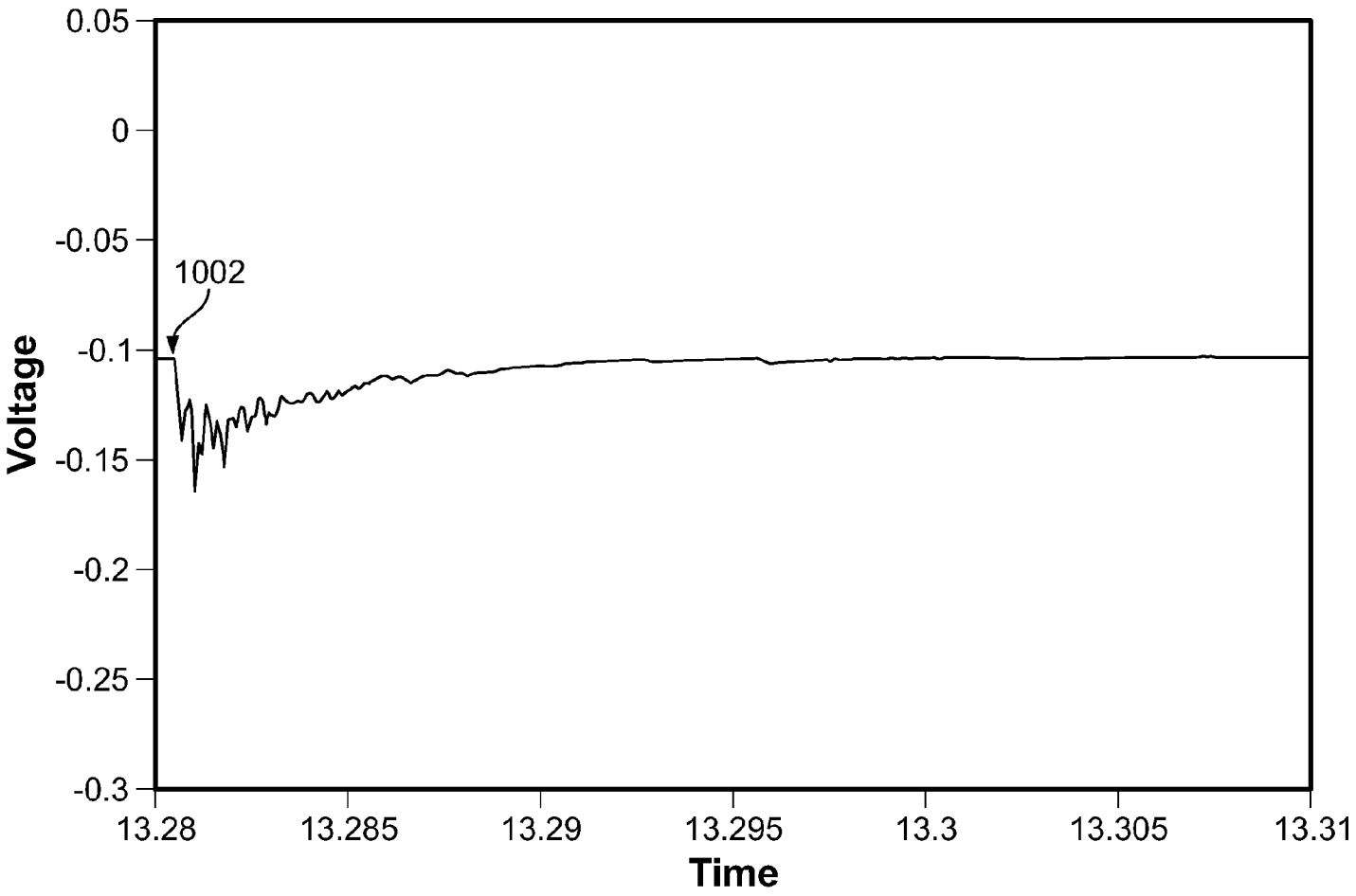
FIG. 11 shows an enlarged portion of the graph in FIG. 10.

The dampened behavior observed in this testing is evident in the voltage measurements also over very short time periods. FIG. 11 shows an enlarged portion of the graph in FIG. 10. The point 1002 where the housing was first rapped is indicated, and the contact does exhibit some initial voltage fluctuations. Very shortly thereafter, however, the dampened system brings the oscillating voltage toward a relatively stable value at a level just below negative 0.1V.

In the above examples, oscillation in an electromagnetic switch was eliminated by way of a damping interface between the moveable contact and the driving shaft which reduced the resonant response of the system and thereby suppressed the oscillation. Oscillation can be reduced or avoided in one or more other ways. In some systems, a damping interface as described herein can be used in connection with one or more such other ways of countering oscillation. In other systems, the other oscillation countermeasure(s) can be used without the specific damping interface.

Figure 12:
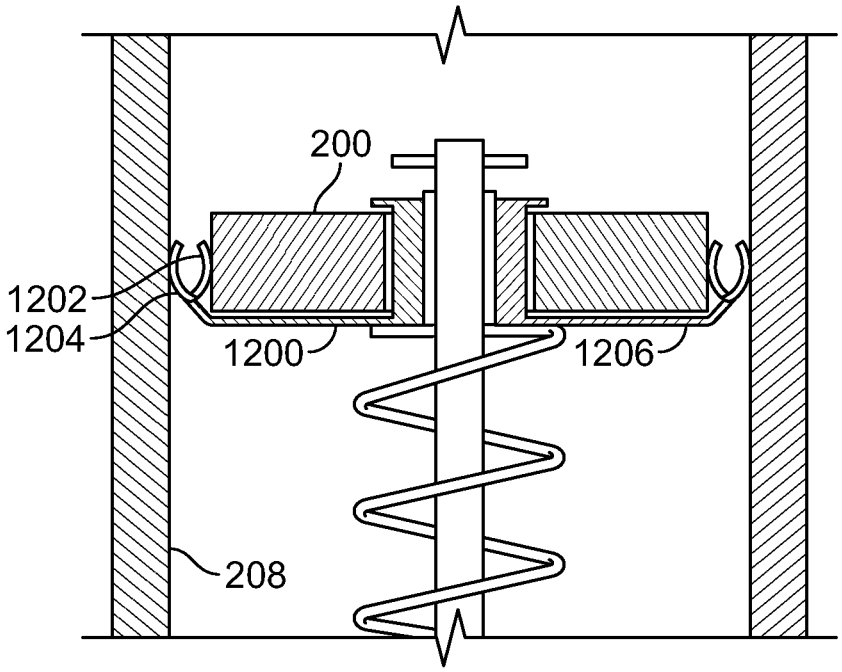
FIG. 12 shows an example of the moveable contact of FIG. 2 having a friction damper.

FIG. 12 shows an example of the moveable contact 200 of FIG. 2 having a friction damper 1200. The friction damper includes members 1202 and 1204 that bias against the moveable contact and the sidewall 208, respectively. The members 1202-04 extend from a member 1206 on which the moveable contact sits. When the contact 200 travels back and forth in the reciprocal motion, the friction damper can serve to reduce or eliminate oscillations by way of the friction existing between the member(s) 1202 and the sidewall(s).

Figure 13:
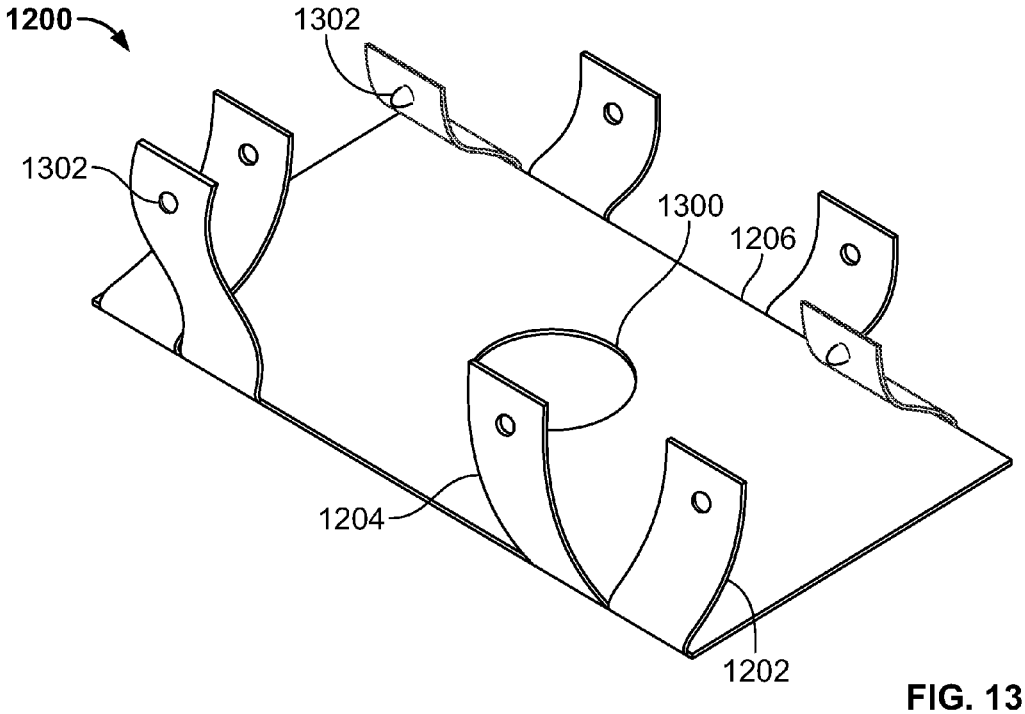
FIG. 13 shows the friction damper of FIG. 12.

FIG. 13 shows the friction damper 1200 of FIG. 12. In this example, the friction damper is made from a relatively thin strip of metal, such as steel, and the moveable contact is not shown for simplicity. The members 1202-04 are here blades that extend essentially in an upward direction from the member 1206, which is essentially flat and has an opening 1300 through which the shaft (not shown) can pass. The members 1202-04 can have one or more nubs 1302 on the side that faces the moveable contact or the sidewall, respectively.

For example, the friction damper can be manufactured from a somewhat wider strip than the member 1206, and the sides can be trimmed so that only the members 1202-04 remain attached to the member 1206. Thereafter, the members 1202-04 can be bent into the position shown, optionally with a contour, for example as shown. That is, the member 1202 can be curved in the general direction of the moveable contact—that is, inward over the metal plate. Similarly, the member 1204 can be curved toward the sidewall; that is, outward from the metal plate. As another example, the members 1202-04 can be formed as one or more separate pieces that are then attached to the member 1206.

Figure 14:
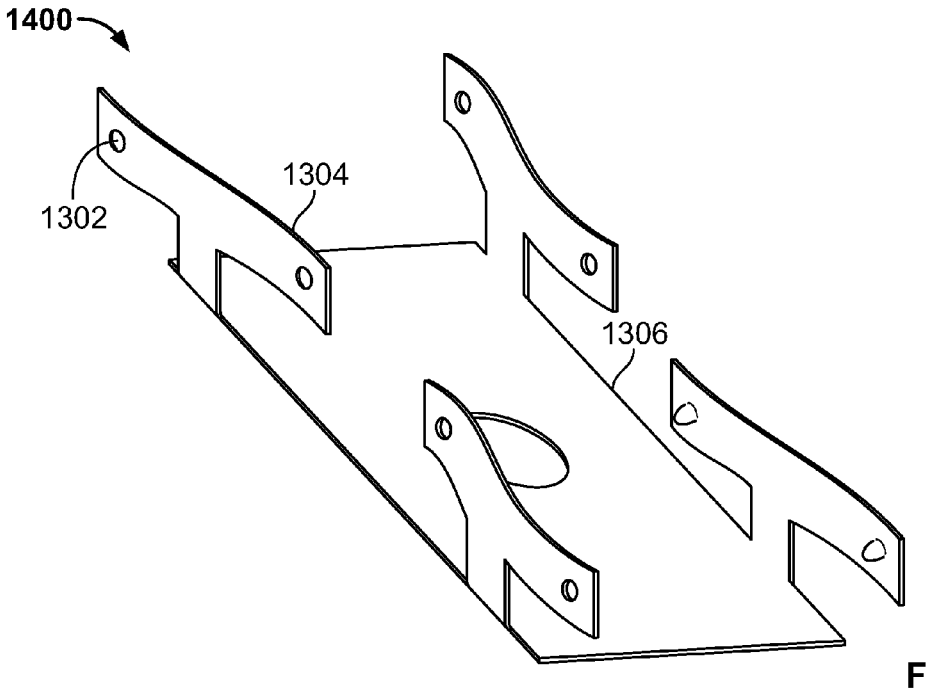
FIGS. 14-16 show other examples of friction dampers.
Figure 15:
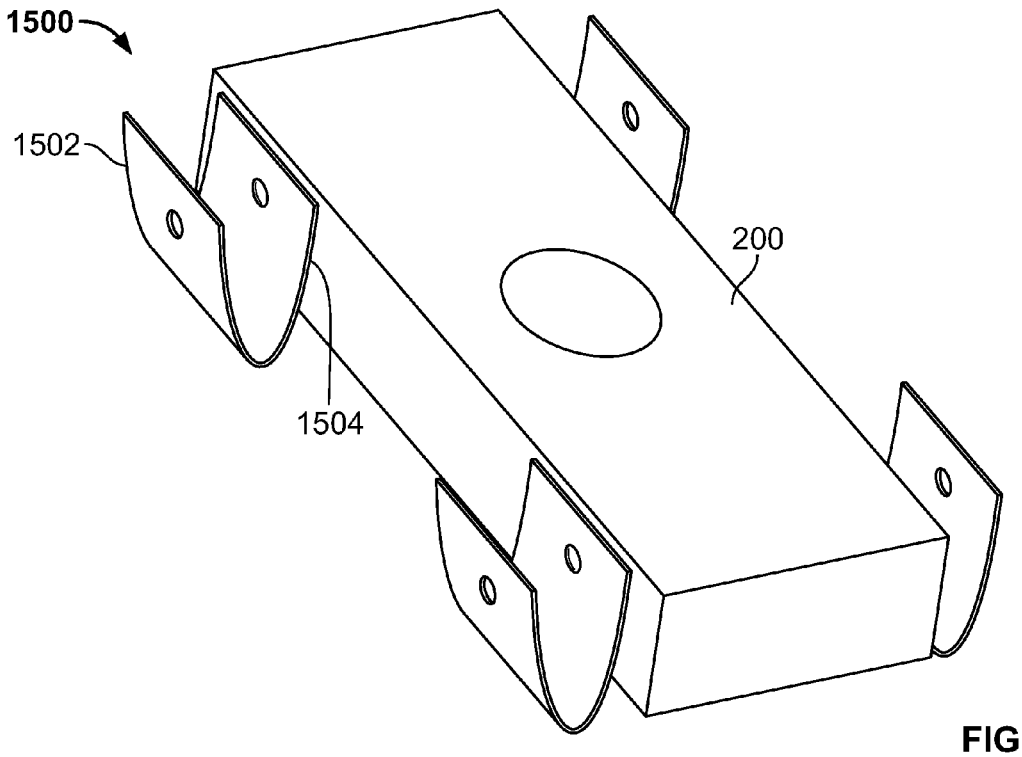
Figure 16:
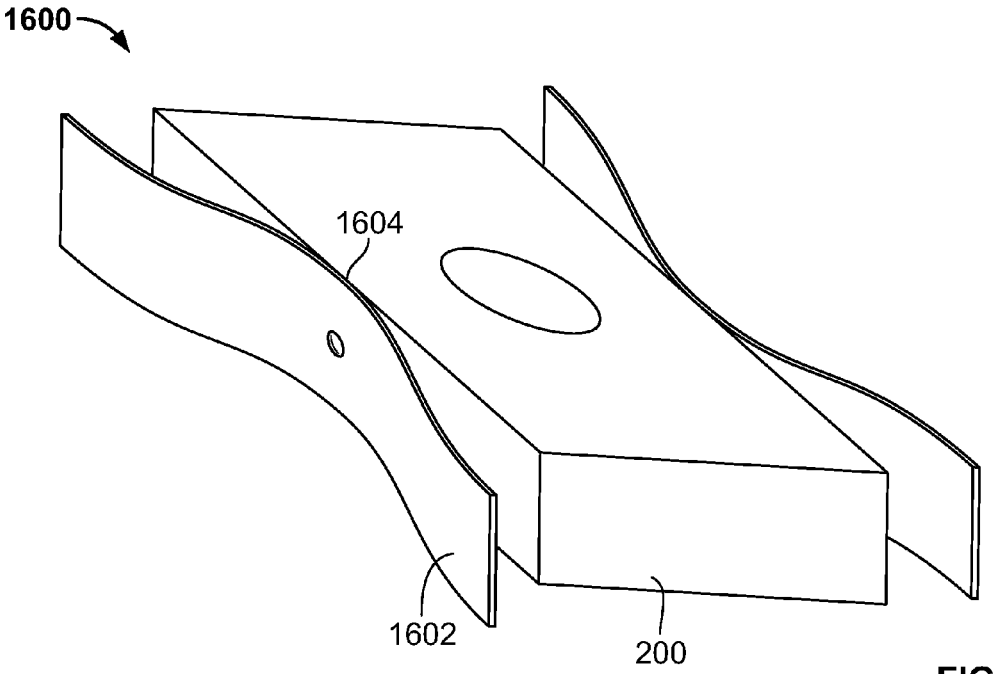

FIGS. 14-16 show other examples of friction dampers. In FIG. 14, a friction damper 1400 has a member 1402 to bias against the sidewall, a member 1404 to bias against the moveable contact (not shown), and a member 1406 from which the members extend. The friction damper can be manufactured in a similar way as described above.

In FIG. 15, a friction damper 1500 is shown attached to the moveable contact 200. The friction damper has a member 1502 to bias against the sidewall, and a member 1504 to bias against the moveable contact. The friction damper can be manufactured from a single strip of metal that is bent into a suitable shape (e.g., a V-shape) and is then attached to the contact. Any suitable attachment technique can be used, including, but not limited to, spot welding.

In FIG. 16, a friction damper 1600 is shown attached to the moveable contact 200. The friction damper includes a member with one or more portions 1602 to bias against the sidewall, and a portion 1604 to bias against the moveable contact. The friction damper can be manufactured from a single strip of metal that is bent into a suitable shape (e.g., as shown) and is then attached to the contact. Any suitable attachment technique can be used, including, but not limited to, spot welding.

A number of implementations have been described as examples. Nevertheless, other implementations are covered by the following claims.

What is claimed is:

1. An electromagnetic switch comprising:

a stationary electrical contact;

a moveable electrical contact;

an actuated member to which the moveable electrical contact is attached for driving the moveable electrical contact into and out of contact with the stationary electrical contact; and a damping interface between the moveable electrical contact and the actuated member, wherein the damping interface is attached entirely inside an opening of the moveable electrical contact through which the actuated member passes.

2. The electromagnetic switch of claim 1, wherein the damping interface is cylindrical.

3. The electromagnetic switch of claim 1, wherein the damping interface is toroidal.

4. The electromagnetic switch of claim 3, wherein the damping interface comprises an O-ring seated in a circumferential groove inside an opening of the moveable electrical contact through which the actuated member passes.

5. The electromagnetic switch of claim 1, wherein the damping interface has a K-shape profile facing the actuated member.

6. The electromagnetic switch of claim 1, wherein the damping interface has a chevron-shape profile facing the actuated member.

7. The electromagnetic switch of claim 1, wherein the damping interface comprises a flexure diaphragm.

8. The electromagnetic switch of claim 7, wherein the flexure diaphragm comprises a rubber washer, wherein an outer periphery of the rubber washer is attached to the moveable electrical contact inside the opening, and wherein an inner periphery of the rubber washer is attached to the actuated member.

9. An electromagnetic switch comprising:

a stationary electrical contact;

a moveable electrical contact;

an actuated member to which the moveable electrical contact is attached for driving the moveable electrical contact into and out of contact with the stationary electrical contact;

a damping interface between the moveable electrical contact and the actuated member; and a friction damper attached to the moveable electrical contact and driven by the actuated member, the friction damper positioned between the moveable electrical contact and a sidewall of the electromagnetic switch.

10. The electromagnetic switch of claim 9, wherein the friction damper is positioned by a metal member on which the moveable electrical contact sits.

11. The electromagnetic switch of claim 9, wherein the friction damper comprises a first member biasing against the moveable electrical contact, and a second member biasing against the sidewall.

12. The electromagnetic switch of claim 11, wherein the first and second members are essentially parallel and oriented in a direction that the moveable electrical contact is being driven.

13. The electromagnetic switch of claim 12, wherein the first member is attached to the moveable electrical contact, and wherein the second member extends from the first member toward the sidewall.

14. The electromagnetic switch of claim 11, wherein the first and second members are essentially antiparallel and orthogonal to a direction that the moveable electrical contact is being driven.

15. The electromagnetic switch of claim 9, wherein one end of the friction damper is attached to the moveable electrical contact and another end biases against the sidewall.

16. A method comprising:

providing a stationary electrical contact for an electromagnetic switch;

attaching a moveable electrical contact to an actuated member for driving the moveable electrical contact into and out of contact with the stationary electrical contact; and providing a damping interface between the moveable electrical contact and the actuated member, wherein the damping interface is attached entirely inside an opening of the moveable electrical contact through which the actuated member passes.

17. The method of claim 16, further comprising providing a circumferential groove inside an opening of the moveable electrical contact through which the actuated member passes, wherein the damping interface comprises an O-ring seated in the circumferential groove.

18. The method of claim 16, wherein the damping interface comprises a rubber washer, the method further comprising attaching an outer periphery of the rubber washer to the moveable electrical contact inside an opening of the moveable electrical contact through which the actuated member passes, and attaching an inner periphery of the rubber washer to the actuated member.

19. The method of claim 16, further comprising attaching a friction damper to the moveable electrical contact so that the friction damper is driven by the actuated member, the friction damper positioned between the moveable electrical contact and a sidewall of the electromagnetic switch.

20. The electromagnetic switch of claim 8, wherein the rubber washer is attached at least in part using a friction fit.

* * * * *